US012246758B2

(12) United States Patent
Meier

(10) Patent No.: US 12,246,758 B2
(45) Date of Patent: Mar. 11, 2025

(54) CONTROL UNIT FOR A MOBILE SANITARY DEVICE AND MOBILE SANITARY DEVICE COMPRISING SAME

(71) Applicant: Evac GmbH, Wedel (DE)

(72) Inventor: Hendrik Meier, Wedel (DE)

(73) Assignee: EVAC GMBH (COMMERCIAL REGISTER NO. 15949 PI) (DE)

( * ) Notice: Subject to any disclaimer, the term of this patent is extended or adjusted under 35 U.S.C. 154(b) by 921 days.

(21) Appl. No.: 17/297,982

(22) PCT Filed: Nov. 29, 2019

(86) PCT No.: PCT/EP2019/083087

§ 371 (c)(1),
(2) Date: May 27, 2021

(87) PCT Pub. No.: WO2020/109551

PCT Pub. Date: Jun. 4, 2020

(65) Prior Publication Data

US 2022/0089199 A1 Mar. 24, 2022

(30) Foreign Application Priority Data

Nov. 30, 2018 (DE) ..... 202018106834.2

(51) Int. Cl.
*B61D 35/00* (2006.01)
*E03F 1/00* (2006.01)

(52) U.S. Cl.
CPC ..... *B61D 35/007* (2013.01); *E03F 1/006* (2013.01)

(58) Field of Classification Search
CPC ..... B61D 35/007; B63B 29/14; E03F 1/006
See application file for complete search history.

(56) References Cited

U.S. PATENT DOCUMENTS 9,951,504 B2 4/2018 Hoang et al.
2019/0085545 A1* 3/2019 Snyder ..... E03C 1/057

FOREIGN PATENT DOCUMENTS

DE 102004049823 A1 4/2006
DE 102015214636 A1 2/2017
DE 102016118329 A1 3/2018

OTHER PUBLICATIONS

International Patent Application No. PCT/EP2019/083087, International Search Report (and English translation) and Written Opinion, dated Mar. 6, 2020.

* cited by examiner

*Primary Examiner* — Lauren A Crane
(74) *Attorney, Agent, or Firm* — Barnes & Thornburg LLP

(57) ABSTRACT

The invention relates to a mobile sanitary device, in particular for a rail vehicle, comprising a vacuum toilet, a flush button, a power supply, a control device, and a control unit. In particular, the invention relates to a mobile sanitary device comprising a vacuum toilet, a flush button, a power supply, a control device, and a control unit, the control unit comprising a standard circuit board for routing signals, having a standard interface comprising a vacuum toilet connecting means for connecting a vacuum toilet, a flush button connecting means for connecting a flush button, and a power supply connecting means for connecting a power supply, a configuration circuit board comprising a configuration interface having a first configuration connection means, wherein the vacuum toilet connection means, the flush button connection means, the power supply connection means, and the first configuration connection means are conductively coupled to each other, wherein the configuration interface is arranged such that the configuration circuit board is coupled to a control device, and at least one signal carried by the standard circuit board and/or by the configuration circuit board can be tapped, processed and/or driven by the control device.

15 Claims, 7 Drawing Sheets

Figure 1:
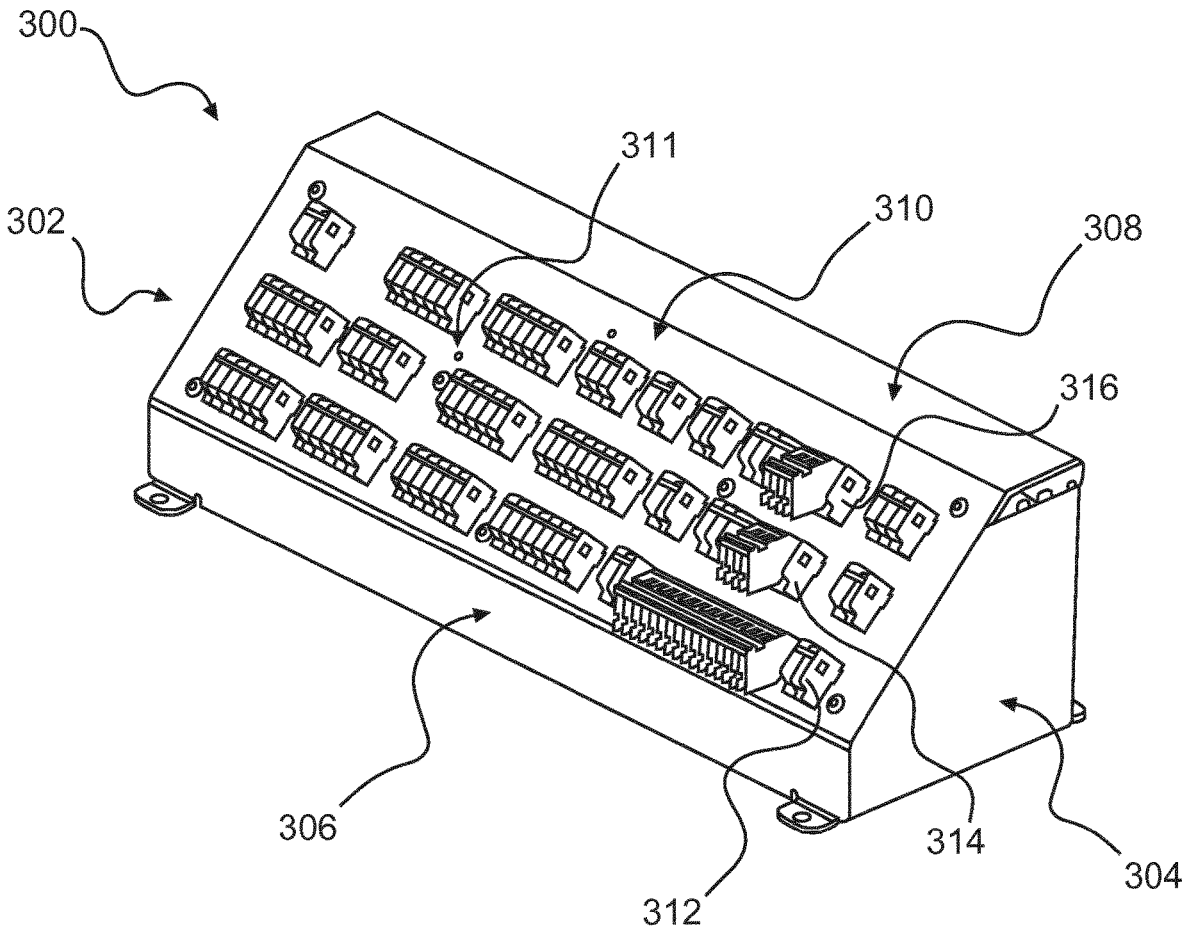

CONTROL UNIT FOR A MOBILE SANITARY DEVICE AND MOBILE SANITARY DEVICE COMPRISING SAME

CROSS-REFERENCE TO RELATED APPLICATIONS

This application is a national stage application of International Patent Application PCT/EP2019/083087, filed on Nov. 29, 2019, which claims priority to Germany Patent Application No. 202018106834.2, filed on Nov. 30, 2018, each of which are hereby incorporated by reference in their entireties.

The invention relates to a mobile sanitary device, in particular for a rail vehicle, comprising a vacuum toilet, a flush button, a power supply, a control device and a control unit. Furthermore, the invention relates to a control unit for a mobile sanitary device, in particular for a mobile sanitary device in a rail vehicle. Furthermore, the invention relates to a method for configuring a mobile sanitary device, in particular a mobile sanitary device for a rail vehicle and to a method for controlling a mobile sanitary device, in particular a mobile sanitary device for a rail vehicle.

Mobile sanitary devices with control units of the type described above are used on board of vehicles, for example track-bound vehicles, in particular rail vehicles, buses, airplanes or watercraft, and in the sense of this description and the claims this shall be described by the term "mobile".

Conventional sanitary facilities in which both the fresh water or flushing water supply and the wastewater discharge are carried out gravitationally, i.e. by gravity alone, are not possible in numerous applications on board of vehicles due to constructional and spatial restrictions. It is therefore common practice to perform fresh and rinse water supply and wastewater discharge by means of an active drive, which is usually controlled by a control device. Such a control device is usually coupled with the components of the mobile sanitary equipment by means of a control unit. In addition to the structural and design advantages, this can also accelerate the water supply and water discharge, resulting in better overall hygiene and functionality of the sanitary facility.

The installation of mobile sanitary equipment on board of vehicles, especially rail-bound vehicles, is complex. As a rule, a mobile sanitary unit is an individual product, with each mobile sanitary unit requiring an individual configuration of the individual components and/or assemblies.

This is due, among other things, to different installation conditions in different vehicles. The complexity is further increased by the fact that divergent requirements can be placed on mobile sanitary equipment. Due to this high complexity and individuality of the mobile sanitary facilities to be installed, a high complexity in development and production can also be observed at manufacturers of mobile sanitary facilities. One of the reasons for this is that the individuality of the product means that few standards can be used, so that many individual parts of the mobile sanitary equipment are tailored to or configured for a specific project. This results in high costs in development and production. The individuality of the mobile sanitary equipment also increases the probability of errors, which results in high control costs. This is particularly high in the case of mobile sanitary facilities, since mobile sanitary facilities must be characterized by a particularly robust and error-free design.

Mobile sanitary equipment is usually controlled by a control device. The control device can, for example, control a vacuum pump of the vacuum toilet. A control unit, also known as a control panel, regularly acts as an interface between a control device and the components of a mobile sanitary facility. Basically, there are two different ways to configure such a control unit. One way of constructing such control units is the clamping technique. Here, the control unit usually comprises a large number of individual clamping terminals, with each individual terminal being configured. One advantage of control units constructed using such clamping terminal technology is that they are highly flexible. Thus, a wide variety of devices of the mobile sanitary unit can be coupled to the control unit. A disadvantage of such a control unit constructed with clamping terminal technology is that this is time-consuming in production and consequently cost-intensive.

Another way to build control units is to provide a circuit board, e.g. a printed circuit board (PCB). A printed circuit board has an internal circuit. Predefined functions can be implemented on a printed circuit board. A printed circuit board is in particular a carrier for electronic components and comprises conductor tracks which act as conductive connections. The advantage of printed circuit boards is in particular that they can be provided as a standard component.

As a standard product, the printed circuit board can always be printed in the same way and equipped with electronic components. However, printed circuit boards are not usually characterized by a high degree of flexibility.

As a rule, printed circuit boards are provided on such products that have a high quantity and a low configuration variance. Short-term changes or changes in the circuitry lead to a high modification effort. This modification effort consists of high one-off costs and in addition, long modification times are required.

In the development and production of mobile sanitary equipment, a decision must therefore be made in each case as to whether the flexible but costly clamping technology should be used or the essentially non-flexible but low-cost printed circuit board for large quantities is used. However, this always leads to compromises in terms of flexibility and cost.

Vehicles are generally designed in such a way that they have a high passenger transport capacity. In particular, as much seating and/or standing space as possible is provided. When designing vehicles, therefore, an attempt is made to provide the traffic routes and sanitary facilities as space-saving as possible. Mobile sanitary facilities must therefore be designed to save as much space as possible. In particular, it is necessary for the individual components of the mobile sanitary facility to have a compact design.

It is therefore a task of the invention to provide a mobile sanitary device, a control unit for a mobile sanitary device, a method for configuring a mobile sanitary device and a method for controlling a mobile sanitary device, which reduce or eliminate one or more of the aforementioned disadvantages. In particular, it is an object of the present invention to provide a solution that enables flexible and cost-effective development and manufacture of mobile sanitation devices. Furthermore, it is an object of the invention to provide a mobile sanitary device that is as space-saving as possible.

According to a first aspect, this task is solved by a mobile sanitary device, in particular for a rail vehicle, comprising a vacuum toilet, a flush button, a power supply, a control device and a control unit, wherein the control unit comprises: a standard circuit board for routing predefined signals, having a standard interface comprising a vacuum toilet connection means for connecting a vacuum toilet, a flush button connection means for connecting a flush button, and a voltage supply connection means for connecting a voltage supply, a configuration circuit board for routing signals, having a configuration interface with a first configuration connection means, wherein the vacuum toilet connection means, the flush button connection means, the voltage supply connection means and the first configuration connection means are conductively coupled to one another, wherein the configuration interface is set up such that the configuration circuit board is coupled to the control device, and at least one signal carried by the standard circuit board and/or by the configuration circuit board can be tapped, processed and/or driven by the control device.

(Printed) circuit boards are also referred to as cards. The standard circuit board and/or the configuration circuit board is preferably designed as a printed circuit board. The standard circuit board and/or the configuration circuit board preferably comprises or includes an electrically insulating material. Furthermore, conductive connections, the so-called conductor tracks, are preferably arranged on this material. The electrically insulating material of the standard circuit board and/or the configuration circuit board can, for example, be a fiber-reinforced plastic or a hard paper.

The standard circuit board includes the standard interface. The standard interface comprises at least the vacuum toilet connection means, the flush button connection means and the voltage supply connection means. The vacuum toilet connection means is arranged such that a vacuum toilet can be connected to the standard circuit board by means of it. By connecting the vacuum toilet to the vacuum toilet connecting means in this way, it is possible to connect the vacuum toilet to the control unit. Further, a signal sent to the control device can thus be routed to the vacuum toilet via the vacuum toilet connection means and a suitable line between the vacuum toilet connection means and the vacuum toilet. Such a control signal may, for example, control a vacuum pump or a compressed air valve of the vacuum toilet.

The flush button connection means is set up to connect the flush button of the mobile sanitary unit to the standard circuit board. The standard circuit board is preferably set up to transmit a flush button signal to the vacuum toilet in such a way that the flush signal causes a flushing process there. This flushing signal can be sent by the control device, for example.

Furthermore, the standard interface of the standard circuit board comprises the voltage supply connection means, which is arranged for connecting a voltage supply. Preferably, the voltage supply connection means is coupled to a voltage transformer. The voltage transformer is preferably arranged on the control unit.

Furthermore, the standard circuit board is preferably set up in such a way that only a vacuum toilet, a flush button and a power supply can be connected to the standard interface. The connection means of the standard interface are preferably designed as plug connections. In particular, it is preferred that the connection means of the standard interface are provided as standardized connection means. The plug connection can be designed as a male connector, for example.

The configuration interface with the first configuration connection means on the configuration circuit board is characterized by a high connection flexibility. The configuration interface with the first configuration connection means is set up to tap, process and/or control at least one signal carried by the standard circuit board and/or the configuration circuit board by the control device. In this way, the configuration interface can be used to intervene in the signal path of the standard circuit board.

In particular, the possibility that a signal carried by the standard printed circuit board and/or the configuration printed circuit board is controlled by the control device provides the possibility of individual signal manipulation. In particular, it is preferred that two or more signals carried by the standard circuit board and/or configuration circuit board are controllable, controllable and/or processable via the configuration interface. It is further preferred that two or more signals carried by the standard circuit board and/or the configuration circuit board are controllable by the control device. Furthermore, it is preferred that any signals carried by the standard circuit board and/or the configuration circuit board are controllable, processable and/or controllable.

The vacuum toilet connection means, the flush button connection means and the voltage supply connection means as well as the first configuration connection means are preferably conductively coupled to a cable harness and can thus be connected to further components. The wiring harness preferably comprises female connectors, which may be of double-row design, for example. As a result, components of a mobile sanitary device, such as vacuum toilet, flush button and/or power supply, can be connected to the control unit and signals can be transmitted. Furthermore, signals can be transmitted from the control device to components of the mobile sanitary device via the standard printed circuit board and the connection means mentioned in the foregoing.

The control unit described in the foregoing is based, among other things, on the realization that mobile sanitary facilities generally have an intersection of functionalities that are always the same. These functionalities can be implemented on the standard circuit board. Due to the standard interfaces with the vacuum toilet connection means, the flush button connection means and the voltage supply connection means, it is possible to connect the components to be connected to it with a standard connector.

The control unit is further based on the realization that this standard configuration for the standard functions can be individually extended by means of a configuration interface. In particular, the flexibility of the control unit is increased by the possibility of tapping, processing or controlling signals carried by the standard circuit board and/or the configuration circuit board. Due to a control unit as described in the foregoing, two target values that have been previously impossible or difficult to combine in the field of control units for mobile sanitary equipment, namely a high degree of standardization and a high degree of flexibility, can be combined.

The control unit described enables the extensive use of standard components. The control unit can be used as a standard component in a wide range of individually configured mobile sanitary equipment. The control unit thus offers the efficiency explained at the beginning by means of the standard circuit board, which in the past, however, restricted flexibility too much. However, the configuration PCB now makes it possible to increase the flexibility of the control unit. This flexibility, which was achieved in the past through the terminal strip technology, can now be achieved through the configuration interface. The control unit, in conjunction with a wiring harness, preferably makes it possible to dispense with any terminal technology and single-wire wiring in assembly. Consequently, assembly is reduced to installing the modules and plugging in the wiring harness. Furthermore, the control unit enables a standardized base plate on which the control unit can additionally be arranged. The interfaces further enable a standardized configuration matrix of different, predefined cables that vary only in length. Furthermore, due to the standardized control unit, test stands can be simplified and require less effort. Furthermore, the standardized control unit enables simplified processes in production, cost calculation and purchasing, since a minimum stock level can be defined for the standardized control unit.

In addition to the high degree of standardization, the invention was based on the realization that a compact design of the control unit is possible through a standard circuit board and a configuration circuit board. Conventional control units require a large amount of space due to the large number of terminals or the two-dimensional printed circuit board. The control unit described in the preceding makes it possible to arrange the two printed circuit boards in three dimensions, thus enabling a compact design of the control unit. The compact control unit allows the mobile sanitation device to be designed in a more space-saving manner. As a result, the mobile sanitary device takes up less space in a vehicle, which can increase the passenger transportation capacity.

In a preferred further embodiment of the mobile sanitary device, it is provided that the standard circuit board and the configuration circuit board are coupled to each other with a coupling means, wherein preferably the coupling means is formed as a flex connector. The coupling with the coupling means allows the standard circuit board and the configuration circuit board to be individually arranged on the control unit, in particular in a housing of the control unit. In particular, the standard circuit board and the configuration circuit board can be arranged in a space-saving manner to enable a compact design of the control unit.

Another preferred embodiment of the mobile sanitation device is characterized in that the control unit comprises a housing having a cavity, wherein the standard circuit board and the configuration circuit board are arranged in the cavity. Preferably, the planar extensions of the standard circuit board and the configuration circuit board include a circuit board angle with each other. Furthermore, the configuration PCB may be arranged substantially vertically within the housing and/or the standard PCB may be arranged tilted with respect to the vertical. The standard circuit board and/or the configuration circuit board may be arranged spaced from the housing. In particular, it is preferred that the standard printed circuit board and/or the configuration printed circuit board are each arranged spaced from an inner side of the housing by means of spacer elements, in particular sleeves. Fastening can be effected by means of fastening elements, for example by means of rivets extending through the sleeves.

A further preferred embodiment of the mobile sanitary device is characterized in that the control unit comprises a housing with a cavity, wherein the standard circuit board and the configuration circuit board are arranged in the cavity. Preferably, the planar extensions of the standard circuit board and the configuration circuit board include a circuit board angle with each other. Furthermore, the configuration PCB may be arranged substantially vertically within the housing and/or the standard PCB may be arranged tilted with respect to the vertical. The standard circuit board and/or the configuration circuit board may be arranged spaced from the housing. In particular, it is preferred that the standard printed circuit board and/or the configuration printed circuit board are each arranged spaced apart from an inner side of the housing by means of spacer elements, in particular sleeves. Fastening can be effected by means of fastening elements, for example by means of rivets extending through the sleeves.

Furthermore, it is preferred that the standard printed circuit board has an upper standard edge and a lower standard edge arranged opposite thereto, the configuration printed circuit board has an upper individual edge and a lower individual edge arranged opposite thereto, wherein the upper standard edge from the upper individual edge has a smaller protrusion than the lower standard edge from the lower individual edge, and preferably the coupling means is arranged in a region adjacent to the upper standard edge and/or in a region adjacent to the upper individual edge.

In a preferred embodiment of the mobile sanitary device, it is provided that the configuration interface comprises a second configuration connection means, the second configuration connection means is set up for controlling at least one relay, preferably two or more relays, wherein preferably the relay is set up as a pluggable relay, and wherein preferably the second configuration connection means comprises a relay socket or is designed as a relay socket.

The relay socket is preferably arranged on the configuration circuit board. In particular, it is preferred that two or more, in particular three, relay sockets are arranged on the configuration circuit board. It is further preferred that the relay for this purpose is arranged to switch a coil voltage of less than or equal to 24 volts and/or less than or equal to 72 volts and/or less than or equal to 110 volts and/or greater than or equal to 110 volts. Furthermore, the relay may be arranged to switch a coil voltage of from 16 volts to 32 volts, in particular from 16.8 volts to 31.2 volts, and/or from 50 volts to 94 volts, in particular from 50.4 volts to 93.6 volts, and/or from 77 volts to 143 volts.

A further preferred embodiment of the control unit is characterized in that it comprises a third configuration connection means for voltage supply with less than or equal to 24 volts and/or less than or equal to 72 volts and/or less than or equal to 110 volts and/or greater than or equal to 110 volts. Further preferably, the control unit comprises a fourth configuration connection means for voltage supply with less than or equal to 24 volts and/or less than or equal to 72 volts and/or less than or equal to 110 volts and/or greater than or equal to 110 volts. Further, the third configuration connection means and/or the fourth configuration connection means may have a voltage supply of from 16 volts to 32 volts, in particular from 16.8 volts to 31.2 volts. Further, the third configuration connection means and/or the fourth configuration connection means may have a voltage supply of from 50 volts to 94 volts, particularly from 50.4 volts to 93.6 volts. Further, the third configuration connection means and/or the fourth configuration connection means may have a voltage supply of from 77 volts to 143 volts. Furthermore, it is preferred that the third configuration connection means and/or the fourth configuration connection means is arranged on the configuration circuit board.

According to a further preferred embodiment of the control unit, it is provided that the control unit comprises a standard connection side, wherein the standard interface is arranged on the standard connection side. Preferably, the standard circuit board is arranged on an inner side of the housing adjacent to the standard connection side. Further preferably, the control unit comprises a configuration connection side at which the configuration interface is arranged. Preferably, the configuration circuit board is arranged on an inner side of the housing adjacent to the configuration connection side.

In addition, the control unit can comprise an operating side, with switches preferably being arranged on the operating side, as will be explained in more detail below. The standard connection side and/or the configuration connection side preferably have through-openings. Preferably, the through openings are arranged such that the vacuum toilet connection means, the flush button connection means, the power supply connection means and/or the configuration connection means can protrude therethrough. Furthermore, preferably, the connection means mentioned in the foregoing can be reached through the passage openings.

Preferably, the mobile sanitation device comprises a voltage converter coupled to the standard circuit board and/or the configuration circuit board and configured to convert a supply voltage into a working voltage. Further, the mobile sanitary device may comprise a diagnostic device coupled to the standard circuit board and/or the configuration circuit board for analyzing a system state. Furthermore, it is preferred that the mobile sanitary device comprises a maintenance device coupled to the standard circuit board and/or the configuration circuit board for analyzing signals relevant to maintenance.

Furthermore, it is preferred that the vacuum toilet connection means, the flush button connection means and/or the voltage supply connection means are each set up to form a plug connection. Furthermore, a terminal strip can be arranged on the control unit by means of a plug connection.

Due to the vacuum toilet connection means, flush button connection means and voltage supply connection means designed as a plug connection, standard cables can be used which have standard plugs. As a result, the degree of standardization is increased. Preferably, the control unit is designed without terminal strips, which means in particular that it has no terminal strip. If the area of application of a control unit makes it necessary to provide a terminal strip, this can be arranged on the control unit by means of a plug connection.

Furthermore, it is preferred that the first configuration connection means and/or the second configuration connection means and/or the third configuration connection means and/or the fourth configuration connection means is/are designed as a pin header. In particular, the pin headers can be formed in a single row. Such pin headers are preferably made of polyamide. The poles may, for example, be made of or comprise electrolytic copper.

According to a preferred embodiment of the control unit, it is provided that the control unit comprises a switch, wherein the switch is arranged and configured to be couplable to the standard circuit board and/or the configuration circuit board.

Preferably, the switch is pluggably couplable to the standard circuit board and/or the configuration circuit board. Further preferably, the control unit comprises two or more switches, wherein the two or more switches are arranged and configured to be couplable to the standard circuit board and/or the configuration circuit board. Preferably, the switches are pluggably couplable to the standard circuit board and/or the configuration circuit board. preferably, the switch or switches are coupled to the standard circuit board and/or the configuration circuit board. The switch or switches may be associated with an on/off function, a frost drain function, and/or a fault acknowledgement function.

Furthermore, it is preferred that the standard circuit board comprises an emergency call button connection means for connecting an emergency call button, and/or a light button connection means for connecting a light button, in particular for a water tap, and/or a water tap valve connection means for connecting a water tap valve control, and/or a tank level indicator connection means for connecting a tank level indicator, preferably a first tank level indicator connection means and a second tank level indicator connection means, and/or a waste water tank sensor connection means for connecting a waste water tank sensor, and/or a measurement sensor connection means for connecting a measurement sensor, in particular for a fresh water tank.

Furthermore, the standard circuit board may have one, two or more connection means for a diagnostic and maintenance device, and/or a display device, in particular a multi-status display device, and/or a voltage transformer.

Furthermore, it is preferred that the mobile sanitary device comprises an individual device, wherein the individual device is coupled to the control unit by means of the first configuration connection means, wherein preferably the individual device is designed as a frost drainage device. Furthermore, the individual device may be formed as a lighting device, a thermostat or a power supply. Preferably, two or more individual devices are comprised by the mobile sanitary device.

The configuration interface with the first configuration connection means makes it possible to connect any devices to the mobile sanitary unit. As a result, the degree of standardization of the mobile sanitary unit is high despite the high connection flexibility, so that the development and production of the mobile sanitary unit can be designed efficiently. Furthermore, the control unit offers a high degree of flexibility in that individual devices can be connected to it by means of the configuration interface. In particular, it is preferred that the control device is arranged to control the vacuum toilet and/or the flush button in such a way that the flush button and the vacuum toilet are in an operative relationship. In particular, it is preferred that, as soon as the flush button is actuated, the components of the vacuum toilet act in such a way that a flushing process is carried out. Due to the compact design of the control unit with two printed circuit boards, the mobile sanitary facility can be designed to save space, so that the transport capacity of vehicles equipped with the mobile sanitary facility is increased.

According to a further aspect, the above-mentioned task is solved by a control unit for a mobile sanitary device according to one of the embodiments described in the foregoing, having a standard circuit board for routing predefined signals, which has a standard interface comprising a vacuum toilet connection means for connecting a vacuum toilet, a flush button connection means for connecting a flush button, and a voltage supply connection means for connecting a voltage supply, a configuration circuit board for routing signals, which has a configuration interface with a first configuration connection means, the vacuum toilet connection means, the flush button connection means, the voltage supply connection means and the first configuration connection means being conductively coupled to one another, the configuration interface being set up such that the configuration circuit board can be coupled to a control device, and at least one signal carried by the standard circuit board and/or by the configuration circuit board can be tapped off, processed and/or driven by the control device.

According to a further aspect, the aforementioned task is solved by a method for configuring a mobile sanitary facility, in particular a mobile sanitary facility for a rail vehicle, comprising: Providing a vacuum toilet, a flush button, a power supply and a control unit with a standard circuit board for routing predefined signals having a standard interface, comprising a vacuum toilet connection means for connecting a vacuum toilet, a flush button connection means for connecting a flush button, a power supply connection means for connecting a power supply, and a configuration circuit board for routing signals having a configuration interface, comprising a first configuration connection means, said vacuum toilet connection means, said flush button connection means, said power supply connection means, and said first configuration connection means being conductively coupled to each other, connecting said vacuum toilet to said vacuum toilet connection means, said flush button to said flush button connection means, and said power supply to said flush button connection means, and connecting a non-predefined individual device to said first configuration connection means.

According to a further aspect, the above-mentioned task is solved by a method for controlling a mobile sanitary device, in particular a mobile sanitary device for a rail vehicle, comprising the steps: Providing a mobile sanitary device according to one of the embodiments described in the foregoing, connecting a or the control device to the configuration circuit board by means of the first configuration connection means, and controlling and/or tapping and/or processing a signal carried by the configuration circuit board.

The methods and their possible further developments have features or method steps which make them particularly suitable for being used for a described control unit and a mobile sanitary device and their respective further developments. For further advantages, embodiment variants and embodiment details of these further aspects and their possible further embodiments, reference is also made to the previously given description regarding the corresponding features and further embodiments of the mobile sanitary device.

Figure 2:
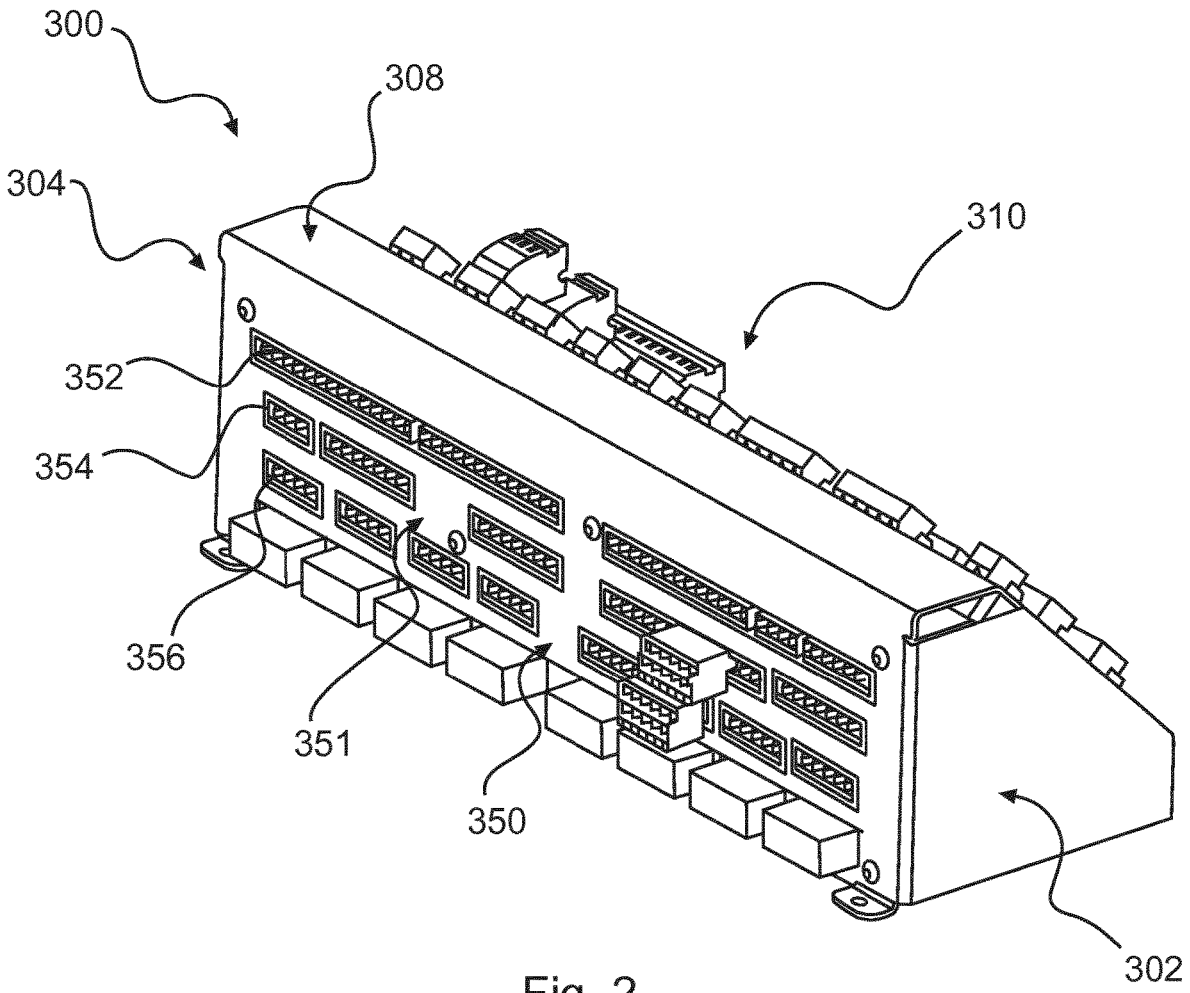
Figure 3:
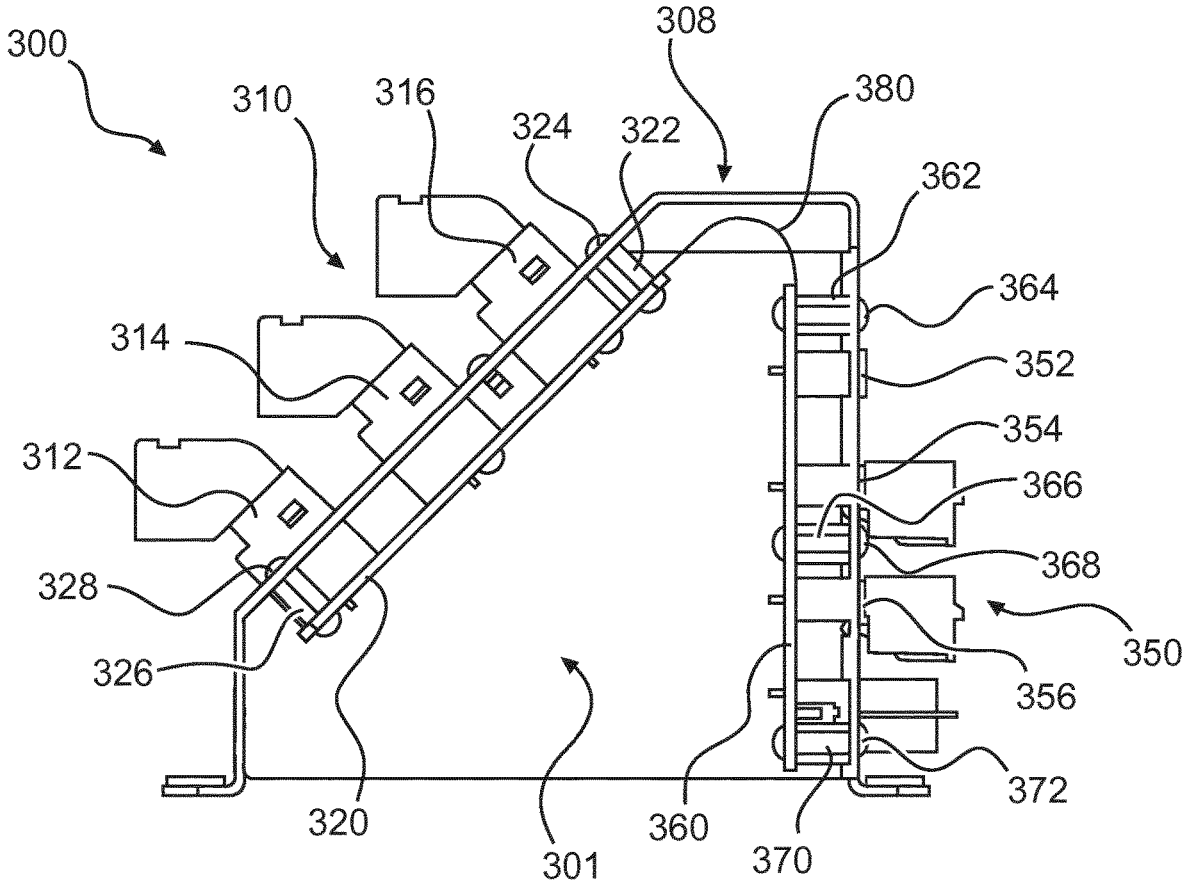
Figure 4:
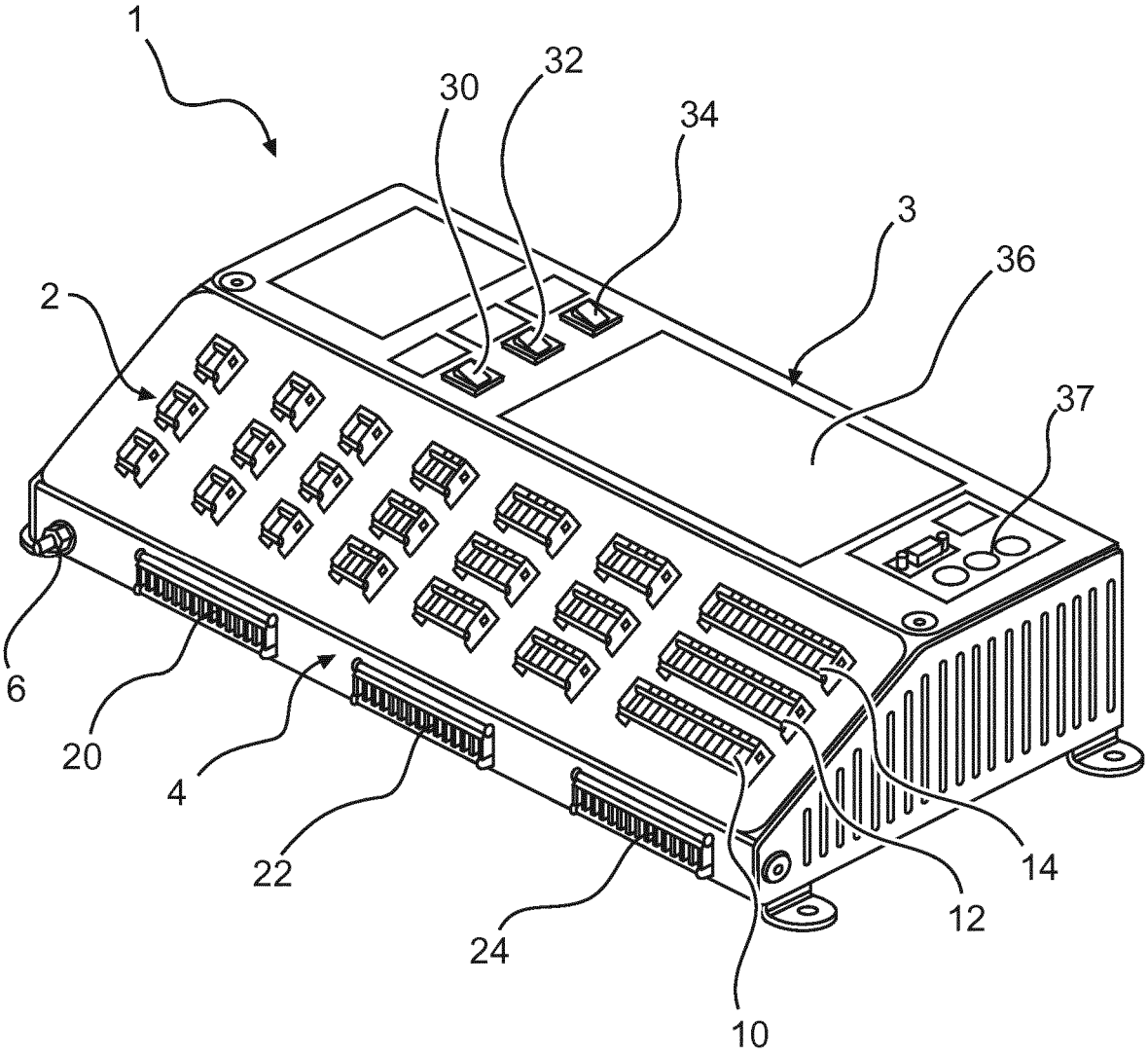
Figure 5:
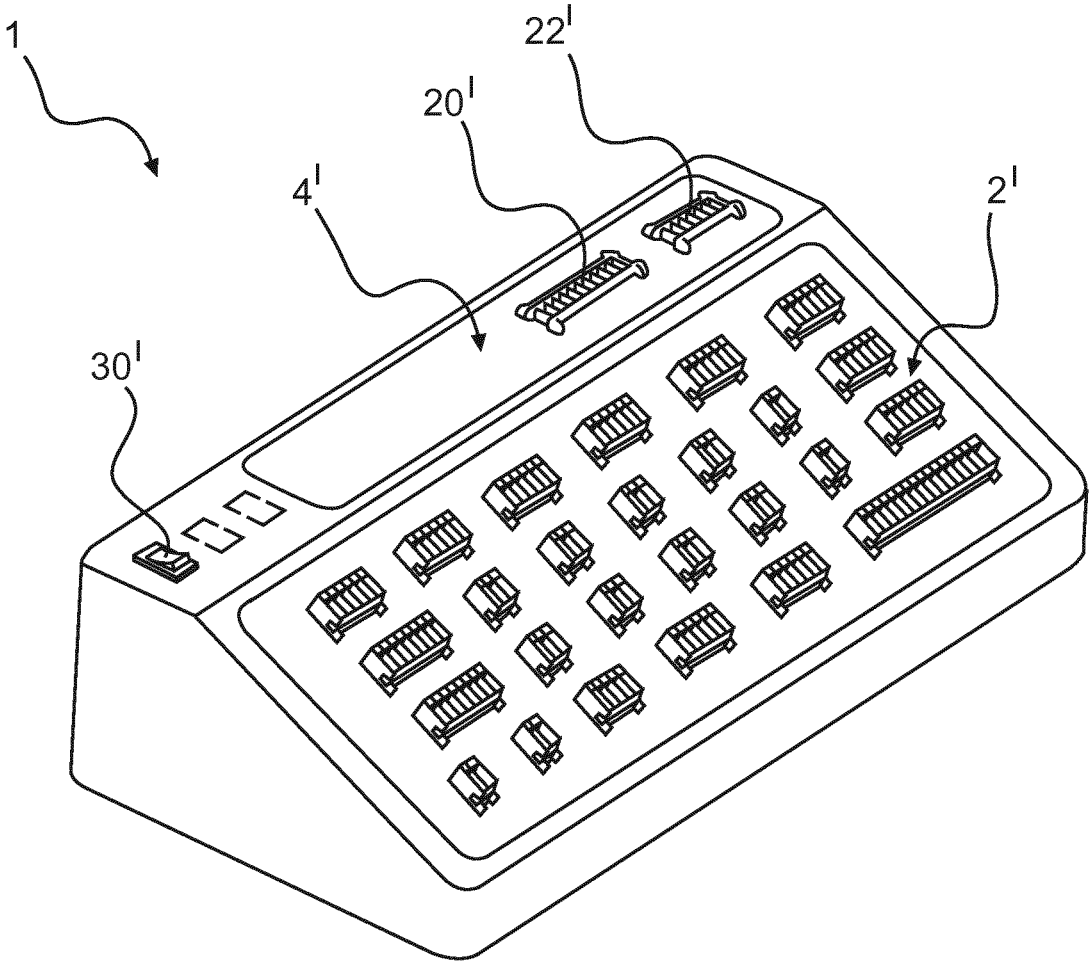
Figure 6:
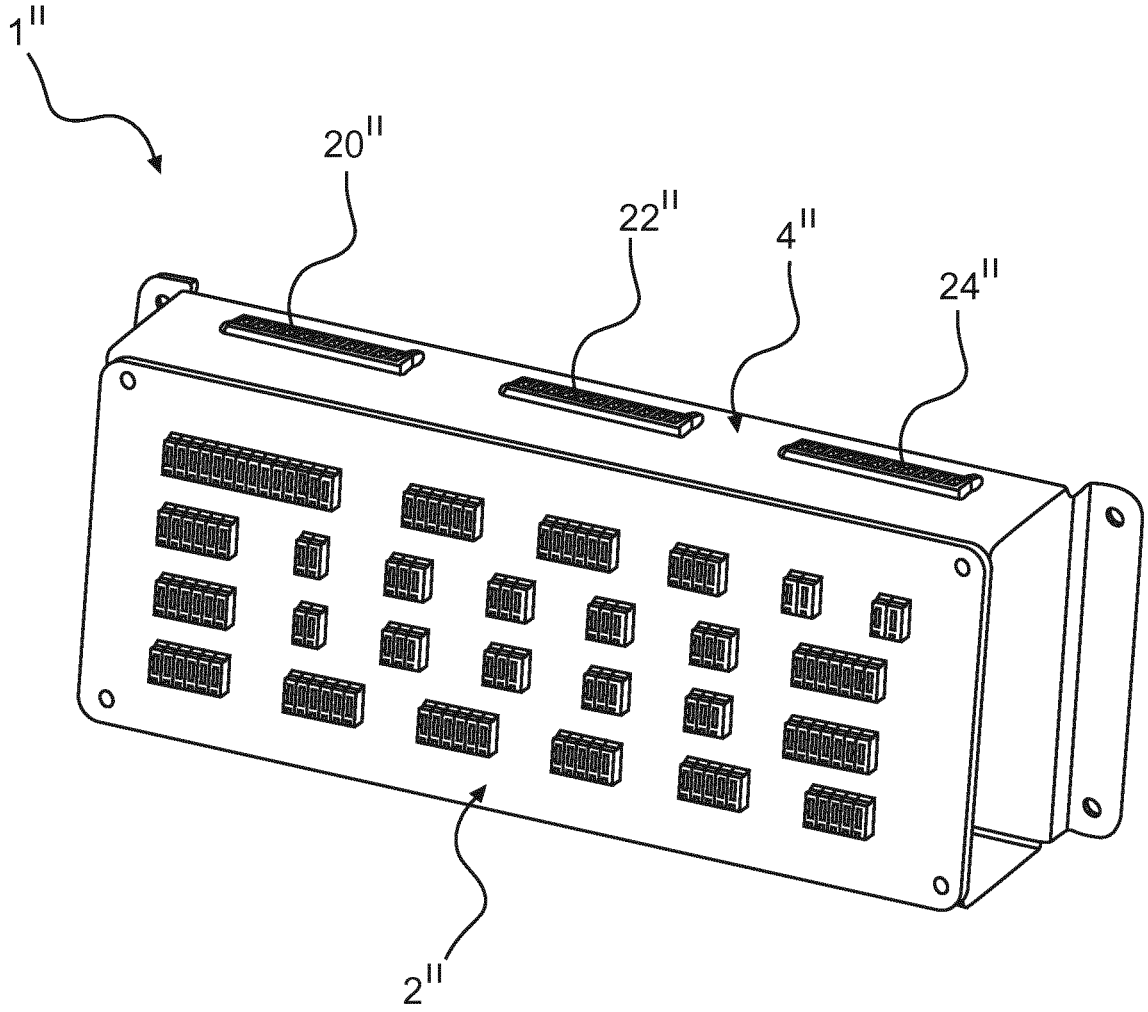
Figure 7:
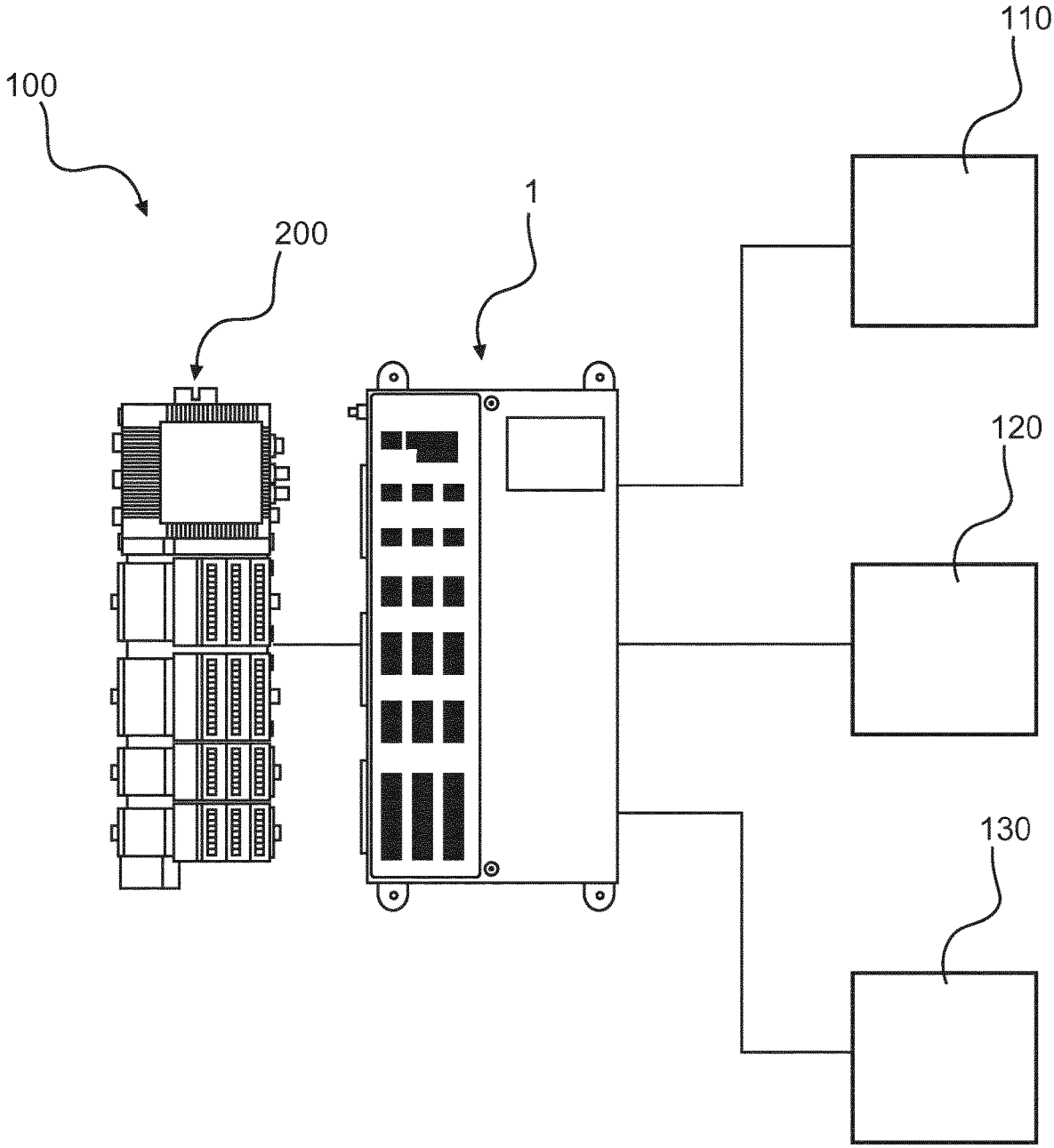

Preferred embodiments are explained by way of example with reference to the accompanying figures. They show:

FIG. 1: a schematic, three-dimensional view of a first exemplary embodiment of a control unit;

FIG. 2: a further schematic, three-dimensional view of the control unit from FIG. 1;

FIG. 3: a schematic, three-dimensional broken view of the control unit from FIG. 1;

FIG. 4: a schematic, three-dimensional view of a further exemplary embodiment of a control unit;

FIG. 5: a schematic, three-dimensional view of a further exemplary embodiment of a control unit;

FIG. 6: a schematic, three-dimensional view of a further exemplary embodiment of a control unit;

FIG. 7: a schematic view of a mobile sanitary unit.

In the figures, identical or essentially functionally identical or similar elements are designated with the same reference signs.

FIG. 1 shows a schematic, three-dimensional view of a first exemplary embodiment of a control unit 300. The control unit 300 extends from the first secondary side 302 to the second secondary side 304. Between the first secondary side 302 and the second secondary side 304 extends the vertically oriented third secondary side 306 and the horizontally oriented top side 308. The third secondary side 306 and the top side 308 are spaced apart in the vertical direction and the horizontal direction. The standard connection side 310 extends between the third secondary side 306 and the top side 308, and between the first secondary side 302 and the second secondary side 304.

A standard interface 311 is disposed on the standard connection side 310 and is encompassed by a standard circuit board 320. The standard interface 311 includes a vacuum toilet connection means 312, a flush button connection means 314, and a power supply connection means 316. Vacuum toilet connection means 312, flush button connection means 314, and power supply connection means 316 can be used to arrange components of a mobile sanitation device that will be explained in more detail below, namely a vacuum toilet, a flush button, and a power supply. In this exemplary embodiment, the standard connection side 310 includes further connection means. The further connection means are arranged for a second flush button, three help call buttons, a sensor of a fresh water tank, two tank level indicators, a faucet valve, a faucet sensor and button, two multifunction displays, four additional sensors and four additional actuators. The components of a mobile sanitary facility mentioned in the preceding may also be standard components. In particular, these components may be coupled to the control unit 300 by means of standardized cables. Furthermore, the standard printed circuit board coupled to these connection means, which will be described in more detail below, can be manufactured as standard, since it can always be set up for the components mentioned in the preceding.

The configuration connection side 350 of the control unit 300 shown in FIG. 2 is vertically oriented and extends from the first secondary side 302 to the second secondary side 304. A configuration interface 351 is arranged at the configuration connection side 350, which is comprised by a configuration circuit board 360. The configuration interface 351 comprises a first configuration connection means 352, a second configuration connection means 354 and a third configuration connection means 356. Any components of a mobile sanitary device can be connected to the first configuration connection means 352, the second configuration connection means 354, the third configuration connection means 356 and the further connection means arranged at the configuration interface 351. The further connection means are designed, for example, as relay actuators or plug-in relays.

FIG. 3 shows a fractured side view of the control unit 300. A cavity 301 is formed through the sides 302, 304, 306, 308, 310, 350. The standard circuit board 320 and the configuration circuit board 360 are arranged in the cavity 301. The standard circuit board 320 is arranged parallel to the surface behind the standard connection side 310. The connection means 312, 314, 316 available at the standard connection side 310 are connected to and protrude from the standard circuit board 320 through openings in the standard connection side 310. The standard circuit board 320 is fixed spaced from the standard connection side 310. The spacing is provided by a first spacing element 322 and a second spacing element 326. The spacing elements 322, 326 are formed as sleeves. The standard circuit board 320 is fixed to the standard connection side 310 by means of the first fastening element 324 and the second fastening element 328. The fastening elements 324, 328 are formed as rivets.

The configuration circuit board 350 is arranged parallel to the surface behind the configuration connection side 350. The connection means 352, 354, 356 available at the configuration connection side 350 are connected to the configuration circuit board 350 and protrude from it through openings in the configuration connection side 350. The configuration circuit board 350 is fixed spaced from the configuration connection side 350. The spacing and fixing is done in a manner analogous to that of the standard circuit board 320 with third, fourth and fifth spacing elements 362, 366, 370 formed as sleeves and with third, fourth and fifth fixing elements 364, 368, 372 formed as rivets.

The standard circuit board 320 and the configuration circuit board 360 are coupled together by a coupling element 380. By coupling the standard circuit board 320 and the configuration circuit board 360, the components of the mobile sanitary device connected to the standard circuit board 320 can be accessed from the configuration interface 351. In particular, signals can be tapped, processed or controlled. Thus, the standard configuration can be accessed.

FIG. 4 shows a schematic, three-dimensional view of a further exemplary embodiment of a control unit. The control unit 1 has an operating side 3, a standard connection side 2 and a configuration connection side 4. The operating side 3 is oriented substantially horizontally. The configuration connection side 4 is oriented substantially vertically. The standard connection side 2 extends between the operating side 3 and the configuration connection side 4. The operating side 3 is arranged at a first height in the vertical direction. The configuration connection side 4 extends in the vertical direction to a second height. The first height is greater than the second height. As shown in FIG. 1, the first height is more than twice the second height. Due to the differences of the first height and the second height, the standard connection side 2 is arranged inclined. In particular, this means that an area orthogonal of the standard connection side 2 has a horizontal component and a vertical component.

The standard interface 42 is arranged on the standard connection side 2. The standard interface 42 is formed by a plurality of connection means. The connection means of the standard interface 42 are designed as connectors. Exemplarily, the vacuum toilet connection means 10, the flush button connection means 12 and the voltage supply connection means 14 are provided with a reference sign. The standard interface 42 with the vacuum toilet connection means 10, the flush button connection means 12 and the voltage supply connection means 14 is arranged on a standard circuit board not shown inside the control unit 1. The connection means shown in FIG. 4 in the form of pin headers of the configuration circuit board arranged inside the control unit project through through-holes inside the standard connection side.

A first configuration connection means 20, a second configuration connection means 22 and a third configuration connection means 24 are arranged at the configuration connection side 4. The first, second and third configuration connection means 20, 22, 24 are coupled within the control unit to a configuration interface arranged on the configuration circuit board. The configuration interfaces are explained in more detail below.

A first switch 30, a second switch 32 and a third switch 34 are arranged on the operating side 3. In addition, a display device 36 is provided on the operating side 3. The display device 36 can be set up, for example, to display error codes. Furthermore, a diagnostic and maintenance device 37 is arranged on the operating side.

FIG. 5 shows a schematic, three-dimensional view of a further exemplary embodiment of a control unit. This alternative design of the control unit 1' also comprises a standard connection side 2', which is also arranged at an angle. The configuration connection side 4' is arranged horizontally, with parts of the functionalities of the control side 3 shown in FIG. 4 being arranged here on the configuration connection side 4', for example the first switch 30'. In the present embodiment of the control unit 1', the latter comprises a plurality of connection means at the standard connection side 2'. A first configuration connection means 20' and a second configuration connection means 22' are arranged at the configuration connection side 4'.

FIG. 6 shows a schematic, three-dimensional view of a further exemplary embodiment of a control unit. The control unit 1" again comprises a standard connection side 2" with a plurality of connection means. Furthermore, this comprises a configuration connection side 4" with a first configuration connection means 20", a second configuration connection means 22" and a third configuration connection means 24".

The control unit 1, 1', 1", 300 shown in FIGS. 1 to 7 enables the efficient and cost-effective development as well as production of a mobile sanitary device 100. The standard interface 42, 311 on the standard printed circuit board 320 enables the standardized connection of standard components, such as a vacuum toilet 110, a flush button 120 and a power supply 130. However, since in the project-related business of mobile sanitation devices such rigid configurations are usually not sufficient, the control unit 1, 1', 1", 300 further provides the possibility to connect further components of a mobile sanitation device 100 to the configuration interface 44, 351. Such a non-standard component may be, for example, a frost drainage device.

However, the control unit 1, 1', 1", 300 can always be provided as a standard component. Thus, the standard printed circuit board and the configuration printed circuit board and, if necessary, also the housing of the control unit 1, 1', 1", 300 are to be manufactured as standard. In the wiring harness as a specific component, the individuality is fully represented, so that the individuality is reduced to the wiring harness. By replacing the wiring harness, a completely new function can be implemented on the control unit 1, 1', 1", 300. If necessary, the entire control unit 1, 1', 1", 300 can be provided as standard. Thus, the control unit 1, 1', 1", 300 can be mass produced so that economies of scale are achieved and costs are reduced. Nevertheless, the control unit 1, 1', 1", 300 can be arranged in a wide variety of projects between the hardware components of a mobile sanitary device 110, 120, 130 and a control device 200 and still allows the mobile sanitary device 100 to be designed flexibly.

ACCESSORIES

1, 1', 1" Control unit
2, 2', 2" Standard connection side
3 Operating side
4, 4', 4" Configuration connection side
6 Grounding element
7 Voltage transformer
10 Vacuum toilet connection means
12 Flush button connection means
14 Voltage supply connection means
20, 20', 20" first configuration connection means
22, 22', 22" second configuration connection means
24, 24" third configuration connection means
30, 30' first switch
32 second switch
34 third switch
36 display device
37 diagnostic and maintenance device
41 standard side
42 Standard interface
43 Individual page
44 Configuration interface
45 first pin header 15-pin
46 second pin header 6-pin
48 first relay socket
50 second relay socket
62 third relay socket

60 Bushing housing
61 first socket housing
62 second socket housing
63 third socket housing
64 fourth bushing housing
65 fifth bush housing
66 sixth bushing housing
67 seventh female housing
70 Wiring harness connection
100 Sanitary equipment
110 vacuum toilet
120 flush button
130 Power supply
200 Control device
300 control unit
301 cavity
302 first side
304 second auxiliary side
306 third side
308 top side
310 standard connection side
311 standard interface
312 Vacuum toilet connection means
314 flush button connection means
316 Power supply connection means
320 standard printed circuit board
322 first spacer element
324 first fastening element
326 second spacer element
328 second fastening element
350 configuration interface
351 configuration interface
352 first configuration connection means
354 second configuration connection means
356 third configuration connection means
360 configuration circuit board
362 third spacer element
364 third mounting element
366 fourth spacer element
368 fourth mounting element
370 fifth spacer
372 fifth fastening element
380 coupling element

The invention claimed is:

1. A mobile sanitary device for a rail vehicle comprising a vacuum toilet, a flush button, a power supply, a control device, and a control unit, wherein the control unit comprises:

a circuit board for carrying predefined signals, having an interface, comprising a vacuum toilet connection means for connecting a vacuum toilet, a flush button connecting means for connecting a flush button, and a voltage supply connection means for connecting a voltage supply, a configuration circuit board for routing signals, comprising a configuration interface with a first configuration connection means, wherein the vacuum toilet connection means, the flush button connection means, the power supply connection means, and the first configuration connection means are conductively coupled together, wherein the configuration interface is configured such that the configuration circuit board is coupled to the control device, and at least one signal carried by the circuit board and/or by the configuration circuit board can be tapped, processed and/or controlled by the control device.

2. The mobile sanitary device according to claim 1, wherein the circuit board and the configuration circuit board are coupled to each other with a coupling means, and wherein the coupling means is formed as a flex connector.

3. The mobile sanitation device according to claim 1, wherein the control unit comprises a housing with a cavity, wherein the circuit board and the configuration circuit board are arranged in the cavity, and planar extensions of the circuit board and the configuration circuit board enclose a circuit board angle with each other, and the configuration circuit board is arranged substantially vertically within the housing and/or the circuit board is arranged tilted with respect to the vertical.

4. The mobile sanitation device according to claim 1, wherein the circuit board has an upper edge and a lower edge arranged opposite thereto, the configuration circuit board comprises an upper individual edge and a lower individual edge arranged opposite thereto, the upper edge is positioned in a smaller distance from the upper individual edge than the lower edge from the lower individual edge, and wherein the coupling means is arranged in a region adjacent to the upper edge and/or in a region adjacent to the upper individual edge.

5. The mobile sanitation device according to claim 1, wherein the configuration interface comprises a second configuration connection means, said second configuration connection means is arranged to control at least one relay, wherein said relay is arranged as a pluggable relay, and wherein the second configuration connection means comprises a relay socket or is designed as a relay socket, and wherein the second configuration connection means is arranged on the configuration circuit board.

6. The mobile sanitation device according to claim 5, wherein the relay is adapted to switch a coil voltage of less than or equal to 24 volts and/or less than or equal to 72 volts and/or less than or equal to 110 volts and/or greater than or equal to 110 V, and preferably the relay is adapted to switch a coil voltage of from 16 volts to 32 volts, in particular from 16.8 volts to 31.2 volts, and/or from 50 volts to 94 volts, in particular from 50.4 volts to 93.6 volts, and/or from 77 volts to 143 volts.

7. The mobile sanitary device according to claim 1, comprising:

a third configuration connection means for voltage supply with 16 volts to 32 volts, in particular with 16.8 volts to 31.2 volts, and/or with 50 volts to 94 volts, in particular with 50.4 volts to 93.6 volts, and/or with 77 volts to 143 volts, and/or a fourth configuration connection means for voltage supply with 16 volts to 32 volts, in particular with 16.8 volts to 31.2 volts, and/or with 50 volts to 94 volts, in particular with 50.4 volts to 93.6 volts, and/or with 77 volts to 143 volts, and wherein the third configuration connection means and/or the fourth configuration connection means is arranged on the configuration circuit board.

8. The mobile sanitary device according to claim 1, comprising a voltage converter coupled to the circuit board and/or the configuration circuit board, which is arranged to convert a supply voltage into a working voltage, and/or a diagnostic device coupled to the circuit board and/or the configuration circuit board for analyzing a system state, and/or a maintenance device coupled to the circuit board and/or the configuration circuit board for analyzing signals relevant to maintenance.

9. The mobile sanitary device according to claim 1, wherein the vacuum toilet connection means, the flush button connection means and the voltage supply connection means are each arranged to form a plug-in connection, wherein the control unit is designed without integrated terminal clamping strips, and wherein a terminal clamping strip can be arranged on the control unit by means of a plug connection.

10. The mobile sanitary device according to claim 1, further comprising a first configuration connection means, a second configuration connection means, a third configuration connection means and/or a fourth configuration connection means is/are configured as a multi-pin connector strip.

11. The mobile sanitary device according to claim 1, wherein the circuit board comprises:

an emergency call button connection means for connecting an emergency call button, and/or a light button connection means for connecting a light button, in particular for a water tap, and/or a faucet valve connecting means for connecting a faucet valve control, and/or a tank level indicator connecting means for connecting a tank level indicator, preferably a first tank level indicator connecting means and a second tank level indicator connecting means, and/or a waste water tank sensor connecting means for connecting a waste water tank sensor, and/or a sensor connection means for connecting a sensor, in particular for a fresh water tank.

12. The mobile sanitary device according to claim 1, comprising an individual device, wherein the individual device is coupled to the configuration circuit board by means of the first configuration connection means, wherein preferably the individual device is configured as a frost emptying device.

13. The mobile sanitary device according to claim 1, wherein the control device is arranged to control the vacuum toilet and/or the flush button, in such a way that the flush button and the vacuum toilet are in an operative relationship.

14. A method for configuring a mobile sanitary device, in particular a mobile sanitary device for a rail vehicle, comprising:

providing a vacuum toilet, a flush button, a voltage supply and a control unit with a circuit board for carrying predefined signals and having a interface, the standard interface comprising a vacuum toilet connection means for connecting a vacuum toilet, a flush button connection means for connecting a flush button a power supply connection means for connecting a power supply, and a configuration circuit board for routing signals having a configuration interface comprising a first configuration connection means, wherein the vacuum toilet connection means, the flush button connection means the power supply connection means, and the first configuration connection means are conductively coupled to each other, connecting the vacuum toilet to the vacuum toilet connection means, the flush button to the flush button connection means, and the power supply the flush button connection means, and connecting a non-predefined individual device to the first configuration connection means.

15. A method for controlling a mobile sanitary device, in particular a mobile sanitary device for a rail vehicle, comprising providing a mobile sanitary device according to claim 1, connecting a or the control device to the configuration circuit board by means of the first configuration connection means, and driving and/or tapping and/or processing a signal carried by the configuration circuit board.

* * * * *